US006634293B2

(12) United States Patent
Hofheinz et al.

(10) Patent No.: US 6,634,293 B2
(45) Date of Patent: Oct. 21, 2003

(54) INK METERING SYSTEM IN A PRINTING PRESS WITH PIEZOELECTRIC ACTUATING ELEMENT

(75) Inventors: Walter Hofheinz, Heidelberg (DE); Jürgen Maass, Wiesloch (DE); Hubert Scheib, Ubstadt-Weiher (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/010,272

(22) Filed: Nov. 13, 2001

(65) Prior Publication Data

US 2002/0088358 A1 Jul. 11, 2002

(30) Foreign Application Priority Data

Nov. 10, 2000 (DE) ..... 100 55 827

(51) Int. Cl.[7] ..... B41F 31/05
(52) U.S. Cl. ..... 101/365; 101/DIG. 47
(58) Field of Search ..... 101/365, 484, 101/485, DIG. 47

(56) References Cited

U.S. PATENT DOCUMENTS 4,381,708 A * 5/1983 Hirt et al. ..... 101/365
5,287,808 A * 2/1994 Lippold ..... 101/365
5,438,927 A * 8/1995 Banike et al. ..... 101/365
6,029,573 A * 2/2000 Capdeboscq ..... 101/350.6
6,062,139 A * 5/2000 Tomita et al. ..... 101/365

FOREIGN PATENT DOCUMENTS

| | | |
|---|---|---|
| DE | 2728738 | 1/1979 |
| DE | 3727656 A1 | 3/1989 |
| DE | 3914831 A1 | 11/1990 |
| DE | 9112926.5 | 1/1992 |

OTHER PUBLICATIONS

Japanese Patent Abstract No. 2–29337 (Takei), dated Jan. 31, 1990.

Japanese Patent Abstract No. 3–227240 (Isono et al.), dated Oct. 8, 1991.

* cited by examiner

*Primary Examiner*—Andrew H. Hirshfeld
*Assistant Examiner*—Leo T. Hinze
(74) *Attorney, Agent, or Firm*—Laurence A. Greenberg; Werner H. Stemer; Gregory L. Mayback

(57) ABSTRACT

An ink metering system in a printing press is described. The printing press has a roller that is divided into a plurality of ink zones, whereby each of the ink zones has an associated piezoelectrical actuating drive. An ink metering system is characterized by a control device containing the actuating drive and a sensor.

11 Claims, 4 Drawing Sheets

INK METERING SYSTEM IN A PRINTING PRESS WITH PIEZOELECTRIC ACTUATING ELEMENT

BACKGROUND OF THE INVENTION

1. Field of the Invention

The invention is directed to an ink metering system in a printing press that is divided into ink zones, whereby each of which has a piezoelectrical actuating drive.

Piezoelectrical actuating drives are known per se, as can be seen from Published, Non-Prosecuted German Patent Application No. 44 45 642 A1, and are used in different technical fields.

German Utility Model No. 91 12 926 U1 describes an ink metering system corresponding to the ink metering system of the aforementioned species. The regulation, actually the control, occurs according to a stored characteristic curve reproducing the context by an applied voltage and alternation of length of the piezoelectrical actuating drive, so that the status message of the respective position of the metering element via potentiometer, as known from other ink metering systems, is not necessary with respect to the ink metering system described in the aforementioned utility model.

What is disadvantageous about it is that hydrodynamic influences of the metered printing ink on the ink metering system and a drift of the metering element occurring in the actuating drive as a result of typesetting processes remain unconsidered.

SUMMARY OF THE INVENTION

It is accordingly an object of the invention to provide an ink metering system in a printing press that overcomes the above-mentioned disadvantages of the prior art devices of this general type, which operates in a more metering-stable manner.

With the foregoing and other objects in view there is provided, in accordance with the invention, an ink metering system for a printing press having a roller divided into ink zones. The ink metering system includes a control device for each of the ink zones. The control device has a piezoelectrical actuating drive and a sensor.

A critical advantage of the inventive ink metering system is its high metering stability.

Modifications of the distance of the metering element from a roller occurring during the metering operation are measured by the sensor and are compensated via a status message by the control device, so that the distance is kept the same under all operating conditions. The metering system is allocated to the roller.

In accordance with an added feature of the invention, the control device has a metering element and the piezoelectrical actuating drive engages the metering element for adjusting the metering element and a distance between the metering element and the roller is a measuring variable of the control device.

In accordance with an additional feature of the invention, the sensor is a distance sensor secured to the metering element and is directed toward the roller.

In accordance with another feature of the invention, the control device has a metering element and the piezoelectrical actuating drive engages the metering element for adjusting the metering element. The control device has a machine element disposed adjacent the metering element, and a distance between the metering element and the machine element is the measuring variable of the control device.

In accordance with a further feature of the invention, the sensor is a distance sensor fastened to the machine element and is directed toward the metering element.

In accordance with a further added feature of the invention, the control device has a gear with a gear element, the piezoelectrical actuating drive and the metering element are connected in terms of driving through the gear element.

In accordance with a further additional feature of the invention, the gear is a translation gear for translating a short regulating distance of the piezoelectrical actuating drive into a long regulating distance of the metering element.

In accordance with another further feature of the invention, the sensor is a deformation sensor attached to the gear.

In accordance with an added feature of the invention, the gear has a flexible joint.

In accordance with a further feature of the invention, the piezoelectrical actuating drive and the metering element have regulating directions deviating from one another.

With the foregoing and other objects in view there is provided, in accordance with the invention a printing press containing a roller divided into ink zones and an ink metering system having a control device for each of the ink zones. The control drive has a piezoelectrical actuating drive and a sensor.

Other features which are considered as characteristic for the invention are set forth in the appended claims.

Although the invention is illustrated and described herein as embodied in an ink metering system in a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
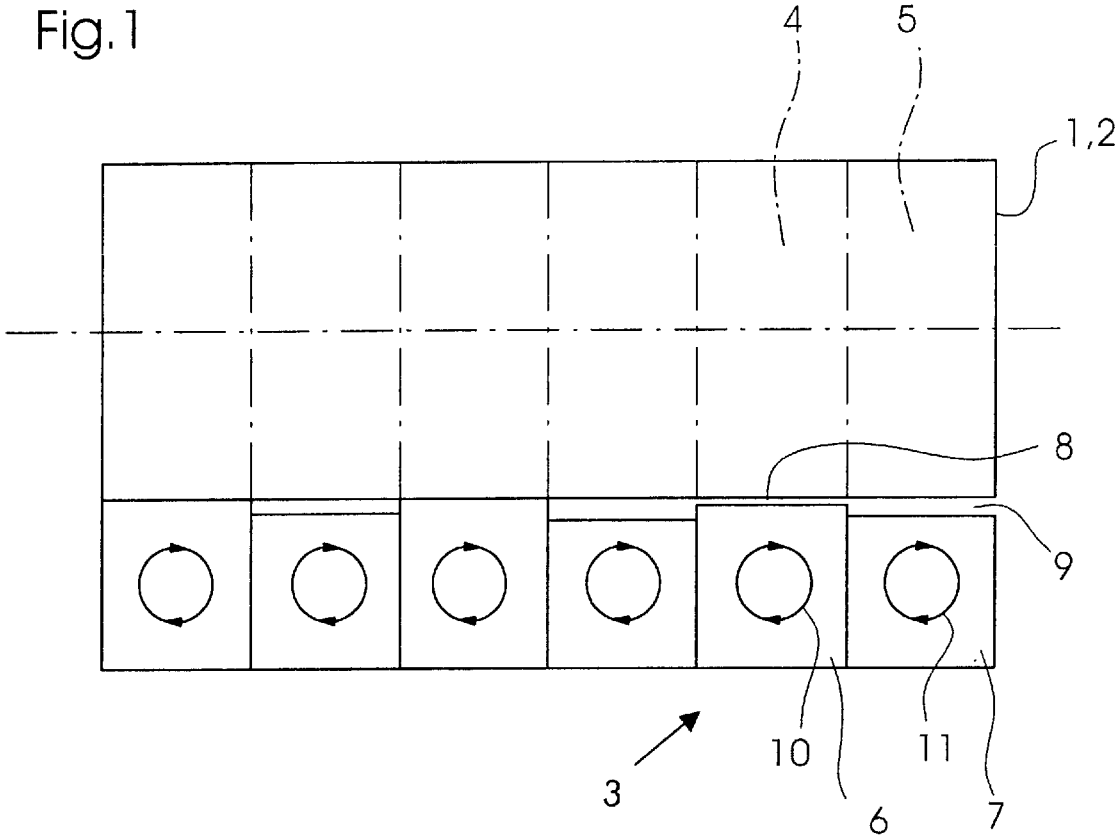
FIG. 1 is an illustration of a roller and an ink metering system allocated to it with control devices according to the invention.

Referring now to the figures of the drawing in detail and first, particularly, to FIG. 1 thereof, there is shown a section of a printing press 1, specifically a rotary offset printing press. The section shows a roller 2 acting as an ink duct roller divided into ink zones 4, 5 and an ink metering system 3 that is allocated to it. The ink metering system is formed of tongue-shaped metering elements 6, 7 which are disposed parallel to the roller 2 and which are individually adjustably toward and away from the roller 2 for generating a zonal ink profile with an ink layer thickness on the roller 2 that is different from ink zone to ink zone. Each of the metering elements 6, 7 adjustable in regards to one another, together with the roller 2, forms a metering nip 8, 9 through which a printing ink of the roller 2 is transported. A control device 10, 11 having a sensor 13, 13' or 13" sensing a measuring value for independently controlling sizes of the metering nip 8, 9 is allocated to each of the metering elements 6, 7. The control device 10, 11 is shown in FIG. 1 with a control circuit symbol.

Figure 2:
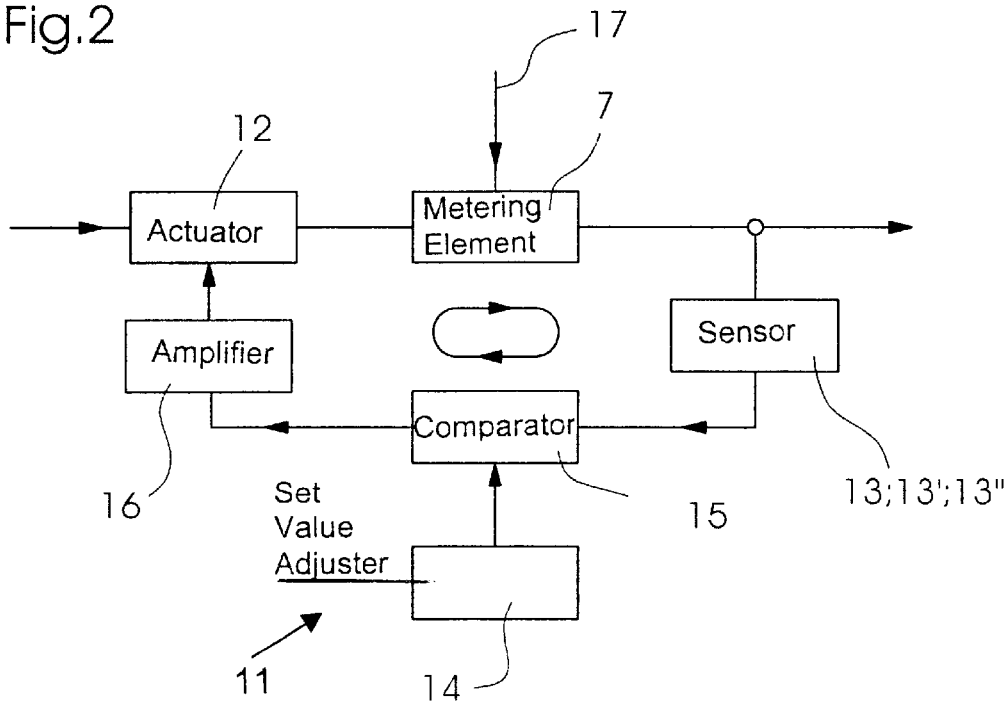
FIG. 2 is a block diagram of one of the control devices.

As an example for all the control devices 10, 11, FIG. 2 shows a block diagram of the control device 11 which is fashioned as a closed loop and which contains an actuator (actuating drive 12), the measuring device (sensor 13, 13' or 13"), a set value adjuster 14, a comparator 15 and an amplifier 16 and which functions as now described.

A metering nip set value that is required for the ink profile is adjusted at the set value adjuster 14, whereby the metering ink set value, in the comparator 15, is compared to a metering nip actual value measured by the measuring device. The comparator 15 determines a deviation of the actual value from the set value, which is caused by a disturbance variable 17 acting upon a controlled system (a metering element 7).

The disturbance variable 17 can be a typesetting process within the actuating drive 12 composed of piezo individual elements that are piled on top of one another or can be a drifting of the metering element 7 from the roller 2 when the hydrodynamic pressure of the printing ink in the metering nip 9 onto the metering element 7 increases as a result of an increase in speed of the roller 2.

Subsequent to a change of sign of the deviation and its amplification in the amplifier 16, the actuator 12 is charged with the negative and amplified deviation, so that a correcting variable is generated which influences the controlled system such that the regulating variable (width of the metering nip 9) assumes the set value again. The amplified deviation is a modification of the electrical voltage at the actuating drive 12, whereby the modification—dependent on the preceding sign —effects an extension or contraction of the actuating drive 12 and therefore an adjustment of the metering element 7.

The sensor 13, 13" can be a non-contact distance sensor, such as an ultrasound sensor, for directly measuring. The sensor 13', however, can also be a deformation sensor, such as a calibrated stretch measuring strip, for indirectly measuring.

Figure 3:
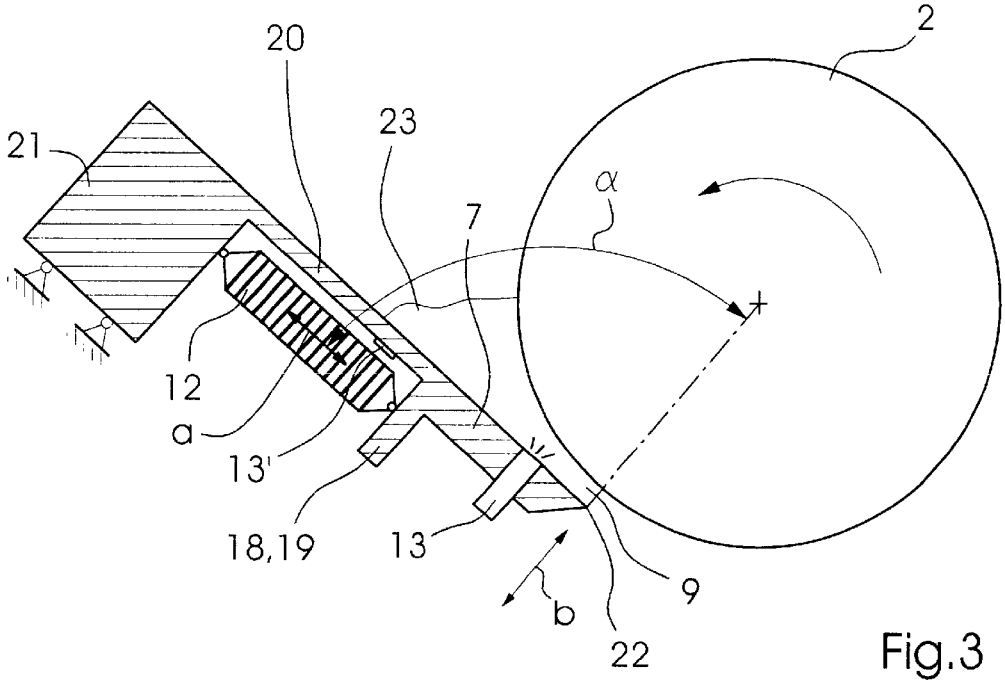
FIGS. 3–7 are sectional views showing different exemplary embodiments and modifications of the ink metering system.

In a side view, FIG. 3 shows a first exemplary embodiment of the ink metering system 3. The actuating drive 12, in terms of driving, is connected to the metering element 7 via a gear element 18 of a translation gear 19. The translation gear 19 enlarges a small regulating distance a of the actuating drive 12 into a large regulating distance b of the metering element 7, which makes it possible for a large ink amount to pass through the metering nip 9. The gear element 18 is a lever arm and resides at a right angle in a direction of the regulating distance a. An angle $\alpha$ extending between a longitudinal axis of the actuating drive 12, which is identical with the linear direction of the regulating distance a, and a radial line of the roller 2 extending through the metering nip 9 is also 90°.

The gear element 18 and the metering element 7 together form an angle lever and are pivotably disposed about a flexible joint 20, i.e. a flector, of the translation gear 19. On one hand, the joint 20 forms a connecting element between the gear element 18 and the metering element 7 and a support 21, on the other hand. The actuating drive 12, which approximately forms a parallelogram together with the plate-shaped or bridged-shaped joint 20, is coupled at the support 21 with its one end and is coupled at the gear element 18 with its other end. The regulating distances a and b are approximately perpendicularly oriented toward one another.

For the positive squeezing or doctoring of the roller 2, the metering element 7 has a wiping edge 22, whose position relative to the roller 2 determines the metering nip 9 and which is set against the roller 2 by forming the metering nip 9 given an open ink zone 5 and is set against the roller 2 practically without forming the metering nip 9 given a closed ink zone 5.

Close to the wiping edge 22, the sensor 13 that is fashioned as a distance sensor 13 and that is directed toward the roller 2 is fastened at the metering element 7, whereby the sensor 13 measures a distance proportional to the metering nip 9 between the metering element 7 and a circumferential surface of the roller 2. The sensor 13 is placed in a borehole of the metering element 7 and is covered by printing ink 23 in a wedge-shaped ink duct that is formed by the metering elements 6, 7, whereby the measuring occurs through the printing ink 23. Instead of the sensor 13, the sensor 13' can also be used for determining the distance of the metering element 7 from the roller 2. The sensor 13' attached to the translation gear 19 is a deformation sensor, specifically is a stretch measuring strip measuring a deformation of the translation gear 19 proportional to the metering nip 9. To be more precise, the sensor 13' is attached to the joint 20 and measures its increasing or decreasing deflection given the adjustment of the metering element 7—dependent on the adjustment direction.

Figure 4:
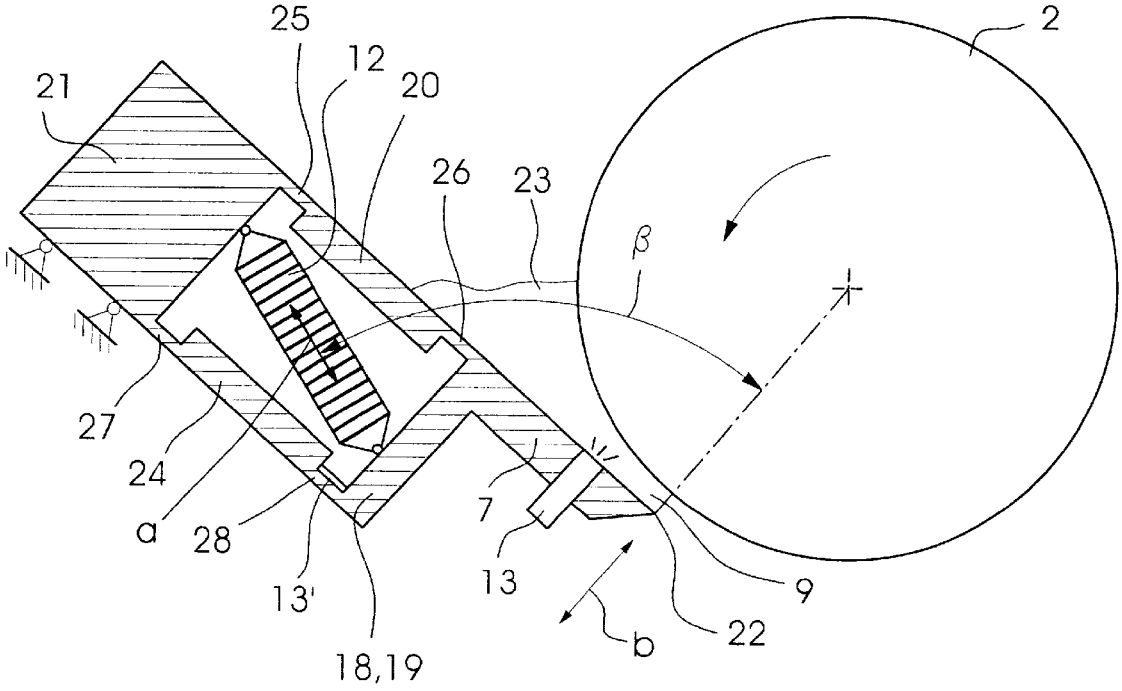

FIG. 4 shows a modification of the first exemplary embodiment and differs from the last one only regarding a few characteristic features, which are subsequently explained in greater detail. In view of the other constructive features, the description of the last exemplary embodiment is valid in terms of sense with respect to the modification, so that the same reference numbers are used in the FIGS. 3 and 4 for components having the same function, so that they do not have to be described a second time.

A characteristic feature of the modification of the first exemplary embodiment is that the support 21 and the gear element 18 are not only connected to one another via the joint 20 but also via a second connector in the form of a flexible joint (flector) 24, so that the support 21, the gear element 18 and the joints 20 and 24 form one single component in the form of a parallelogram or, respectively, closed frame. The end of the actuating drive 12 linked at the support 21 is closer to the joint 20 than the end of the actuating drive 12 linked at the gear element 18, so that its regulating distance a, given the modification of the first exemplary embodiment, extends at an inclined angle relative to the longitudinal direction of the joints 20 and 24 and an acute angle $\beta$ between the longitudinal axis of the actuating drive 12 or, respectively, direction of the regulating distance a and the radial line of the roller 2 extending through the metering nip 9 is less than 90°.

The maximum regulating distance a of the actuating drive 12 is relatively small and can range from 0.05 mm to 0.20 mm. The translation ratio ü=b: a of the translation gear 19 is relatively great and can be ü=10, for example, so that a regulating distance a of 0.10 mm is translated into a regulating distance b of 1.00 mm.

Joint profile tapers 25 to 28 disposed at the ends of the joints 20 and 24 represent a further characteristic feature, whereby set bending points of the joints 20 and 24 are prescribed by the joint profile tapers. Given the modification of the first exemplary embodiment, the sensor 13' is no longer attached to the joint 20 but to the joint 24 in the region of the taper 28.

Figure 5:
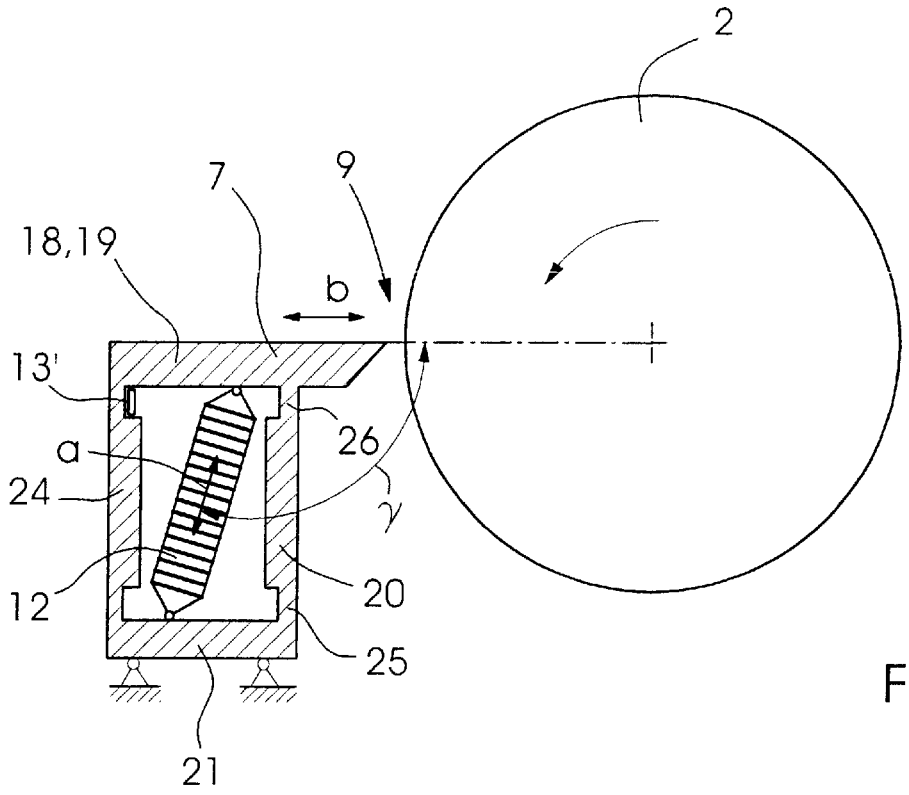

FIG. 5 shows a second exemplary embodiment of the ink metering system 3, which differs from the first exemplary embodiment (FIG. 3) and its modification (FIG. 4) only regarding a few constructive characteristic features. These characteristic features of the second exemplary embodiment are subsequently explained in greater detail. Therefore, the description of the other constructive features, which the second exemplary embodiment and the first exemplary embodiment and its modification have in common, can be transferred from the FIGS. 3 and 4 to FIG. 5, so that the reference numbers already used in the FIGS. 3 and 4 are kept.

A characteristic feature of the second exemplary embodiment is that the metering element 7 and the gear element 18 have longitudinal axes situated in straight alignment, so that the longitudinal axis of the metering element 7 perpendicularly extends relative to longitudinal axes of the joints 20 and 24. This is advantageous with respect to an adjustment of the metering element 7 occurring approximately in a radial direction of the roller 2 for regulating the metering nip 9.

Another characteristic feature of the second exemplary embodiment is the orientation of the actuating drive 12, whose end supported at the gear element 18 is closer to the joint 20 than the end supported at the support 21. Therefore, an angle $\gamma>90°$ arises, in the second exemplary embodiment, between the longitudinal axis of the actuating drive 12 or, respectively, the direction of the regulating distance a identical with the latter, on one hand, and the radial line of the roller 2 extending through the metering nip 9, on the other hand.

Figure 6:
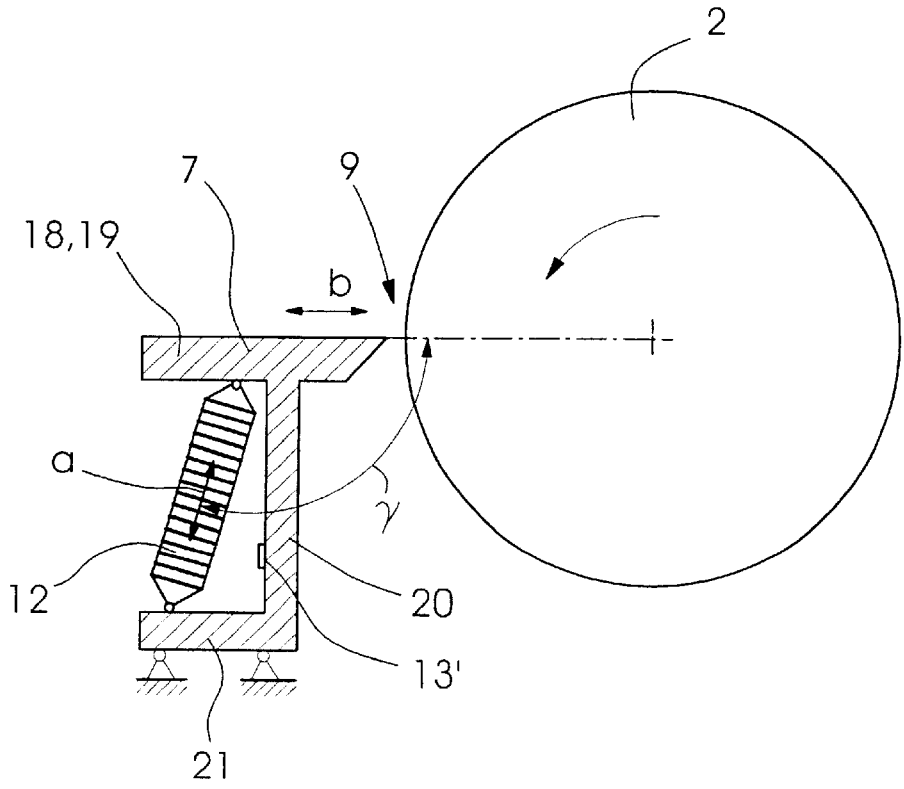

FIG. 6 shows a modification of the second exemplary embodiment, whereby the second joint 24 and the joint profile tapers 25 to 28 are foregone here. Given the modification of the second exemplary embodiment, the gear element 18, the joint 20 and the support 21 together form an essentially U-shaped component. The description of the second exemplary embodiment corresponds to its modification in all points.

Figure 7:
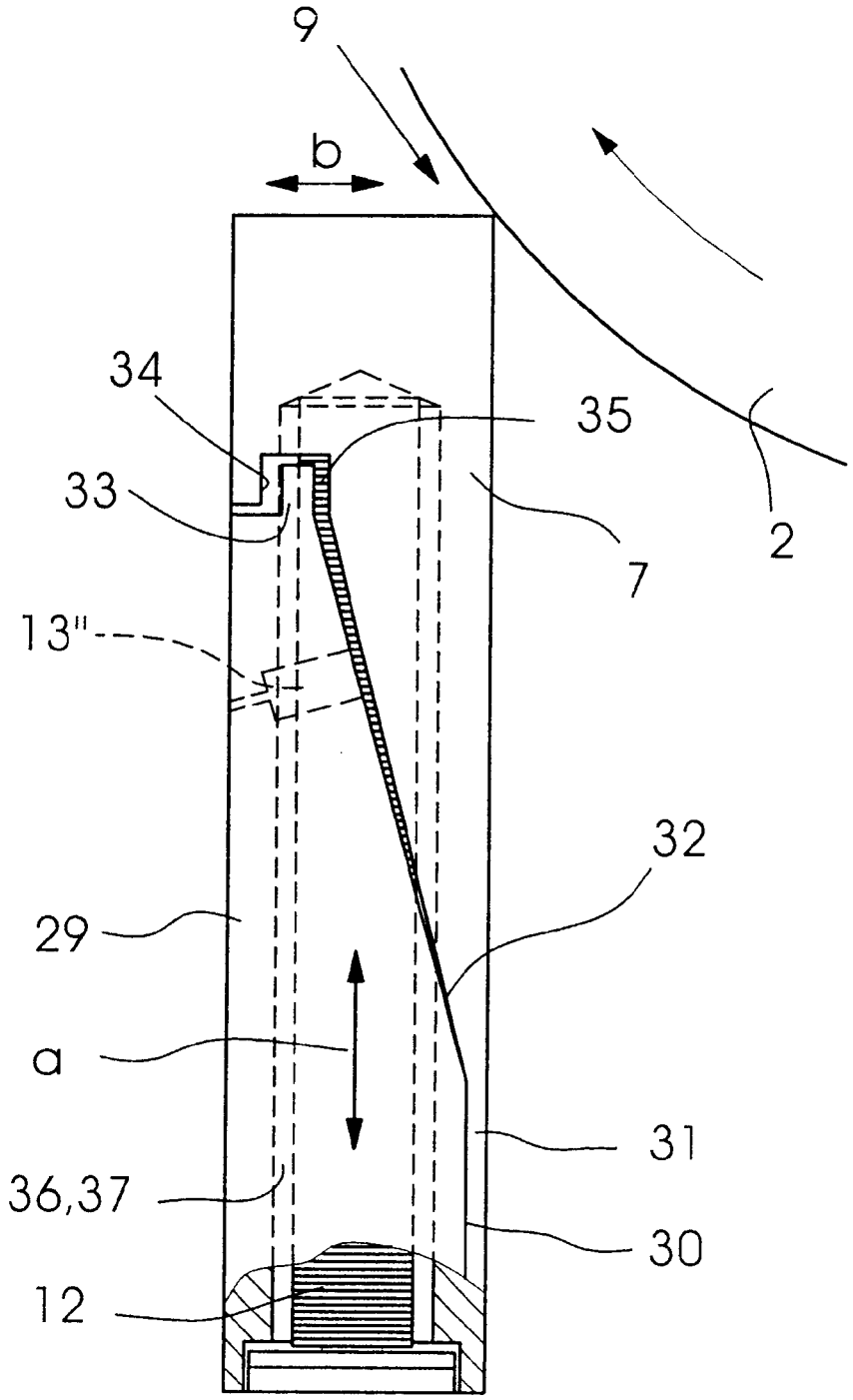

FIG. 7 shows a third exemplary embodiment of the ink metering system 3. The metering element 7 and a machine element 29 in the form of a support 29 are produced from a four-edged shaped bar, which is cut-in along a separating line 30 by an eroding tool.

A straight spring (leaf spring) 31 having a thickness of approximately 1.5 mm, which is connected to the support 29 and which is subject to bending, results from the curve of the separating line 30 at the metering element 7 and essentially wedge-shaped contours of the metering element 7 and the support 29. In the area of the spring 31, which serves the purpose of setting back the metering element 7 away from the roller 2, the separating line 30 extends parallel to an outside surface of the metering element 7, which forms an ink duct bottom and ends in a wiping edge, and also extends parallel to a longitudinal axis or, respectively, to a regulating path a of the actuating drive 12.

In an area following the spring 31, the separating line 30 is expanded to an air gap 32, which extends essentially diagonal and at a flat angle relative to the standardized outside surface of the metering element 7 and to the regulating distance a or, respectively, to the longitudinal axis of the actuating drive. The air gap 32 extends in a U-shaped manner at the end of the separating line 30 opposite the spring 31 and forms a projection 33 of the support 29 between two stop surfaces 34 and 35 of the metering element 7 that are situated opposite to one another.

The actuating drive 12, with its one end, flexibly supports itself at the support 29 and flexibly supports itself at the metering element 7 with its other end and is inserted into a recess 36, which has been drilled through the support 29 and into the metering element 7, before the support 29 and the metering element 7 have been unraveled along the separating line 30. A sufficient margin in the form of an annular gap 37 enabling a swiveling movement of the metering element 7 relative to the support 29 is present between the outside diameter of the actuating drive 12 and the inside diameter of the recess 36 given an utilized actuating drive.

A sensor 13" acting as a distance sensor is embedded into the support 29 in the diagonally extending region of the air gap 32, whereby the sensor 13" is directed to a measuring surface at the metering element 7.

A configuration of the sensor 13" and the measuring surface exchanged with one another vis-à-vis is also conceivable, whereby the sensor 13" is fastened at the metering element 7 and would be directed to the support 29.

The sensor 13" shown in FIG. 7 measures a width of the air gap 32, which changes proportionally to a width of the metering nip 9 given its adjustment, so that an indirect measuring of the measuring nip 9 ensues given its control by the control device 11.

Instead of the sensor 13" measuring the air gap 32, a sensor that is disposed close to the wiping edge of the metering element 7 and that is directed toward the roller 2 can also be used, whereby the sensor is comparable to the sensor 13 of the first two exemplary embodiments.

Regardless of which exemplary embodiment is used for the ink metering system 3, each ink zone 4, 5 has the configuration of the actuating drive 12, of the sensor 13; 13'; 13" and of the support 21; 29 connected in terms of gearing to the metering element 7 as shown in FIG. 3, 4, 5, 6 or 7.

In all exemplary embodiments, the metering nip is independently controlled, whereby the control is as follows. The disturbance variable 17 in the form of the typesetting process makes oneself conspicuous in the actuating drive 12 of the ink zone 5, which therefore slightly collapses in the direction of the regulating path a. As a result thereof, the metering nip enlarges in an undesired manner. The enlargement of the metering nip 9 is measured by the sensor 13; 13' or, respectively, 13" and is signalized to the measuring device 11, which increases the voltage at the actuating drive 12 such that the actuating drive 12 expands and therefore reaches its original position prior to the collapse. The metering nip 9 thereby is set back to the width corresponding to the desired ink profile.

We claim:

1. An ink metering system for a printing press, comprising:

ink zones, the ink metering system being divided into said ink zones;

each of said ink zones having a control device disposed in a closed loop containing a piezoelectrical actuating drive and a sensor; and each of said piezoelectrical actuating drives being formed of individual piezo-elements disposed on top of one another.

2. The ink metering system according to claim 1, wherein said control device has a metering element and said piezoelectrical actuating drive engages said metering element for adjusting said metering element, and a distance between said metering element and a roller is a measuring variable of said control device.

3. The ink metering system according to claim 2, wherein said sensor is a distance sensor secured to said metering element and is directed toward the roller.

4. The ink metering system according to claim 1, wherein:

said control device has a metering element and said piezoelectrical actuating drive engages said metering element for adjusting said metering element; and said control device has a machine element disposed adjacent said metering element, and a distance between said metering element and said machine element is a measuring variable of said control device.

5. The ink metering system according to claim 4, wherein said sensor is a distance sensor fastened to said machine element and is directed toward said metering element.

6. The ink metering system according to claim 1, wherein said control device has a gear with a gear element and a metering element, said piezoelectrical actuating drive and said metering element are drivingly connected through said gear element.

7. The ink metering system according to claim 6, wherein said gear is a translation gear for translating a short regulating distance of said piezoelectrical actuating drive into a long regulating distance of said metering element.

8. The ink metering system according to claim 7, wherein said gear has a flexible joint.

9. The ink metering system according to claim 6, wherein said sensor is a deformation sensor attached to said gear.

10. The ink metering system according to claim 1, wherein said control device has a metering element, and said piezoelectrical actuating drive and said metering element have regulating directions deviating from one another.

11. A printing press, comprising:

a roller;

an ink metering system associated with said roller, said ink metering system being divided into ink zones;

each of said ink zones having a control device disposed in a closed loop containing a piezoelectrical actuating drive and a sensor; and each said prezoelectrical actuating drives being formed of individual piezo-elements disposed on top of one another.

* * * * *